US005832643A

United States Patent [19]

Delaquila et al.

[11] Patent Number: 5,832,643

[45] Date of Patent: Nov. 10, 1998

[54] FULL VIEW CHANGEABLE DISPLAY SIGN

[75] Inventors: Gary E. Delaquila, Wheaton; James W. Leone, Elmhurst; Harold J. Smith, Darien, all of Ill.

[73] Assignee: Wagner Zip-Change, Inc., Melrose Park, Ill.

[21] Appl. No.: 738,728

[22] Filed: Oct. 28, 1996

[51] Int. Cl.[6] ..... G09F 7/02

[52] U.S. Cl. ..... 40/611; 40/575; 40/620

[58] Field of Search ..... 40/575, 576, 611, 40/618, 620, 622, 624

[56] References Cited

U.S. PATENT DOCUMENTS

| | | | |
|---|---|---|---|
| 2,156,257 | 5/1939 | Adler | 40/618 |
| 2,306,511 | 12/1942 | Wagner | 40/618 X |
| 3,262,225 | 7/1966 | Offenhauer | 40/618 |
| 3,634,960 | 1/1972 | Don Carlos | 40/624 X |
| 4,021,949 | 5/1977 | Niehaus et al. . | |
| 4,461,107 | 7/1984 | Grate | 40/576 |
| 4,521,984 | 6/1985 | Murray | 40/576 |
| 4,553,345 | 11/1985 | Bercier et al. | 40/576 |
| 4,682,430 | 7/1987 | Ramsay . | |
| 4,693,026 | 9/1987 | Callahan et al. | 40/576 |
| 4,765,080 | 8/1988 | Conti | 40/576 |
| 4,817,316 | 4/1989 | Walker | 40/576 |
| 4,977,698 | 12/1990 | Seggerson | 40/618 |
| 5,088,221 | 2/1992 | Bussiere et al. | 40/618 |
| 5,347,736 | 9/1994 | Kanigan | 40/576 |
| 5,357,701 | 10/1994 | Grate | 40/620 X |
| 5,367,800 | 11/1994 | Nelson | 40/618 |
| 5,487,231 | 1/1996 | Grate | 40/620 X |
| 5,542,202 | 8/1996 | Brugger | 40/576 |

*Primary Examiner*—Brian K. Green
*Attorney, Agent, or Firm*—Emrich & Dithmar

[57] ABSTRACT

A display sign includes a translucent, planar back panel attached to a front, open portion of a generally rectangular housing which contains a light source. Disposed on a front surface of the back panel in a vertically spaced manner are a first plurality of parallel, linear, horizontally aligned tracks, or rails. The display sign further includes a plurality of front panels each having a respective second plurality of horizontally aligned, vertically spaced, linear tracks on an aft surface thereon. Each of the second tracks is adapted to engage a respective one of the first tracks on the front of the sign's back panel for securely and removably attaching the front panels to the back panel. The depth of each of the second tracks, or the extent each of the second tracks extends outwardly from the aft surface of a front panel, is the same for all tracks on a given front panel, with the depth of the tracks on adjacent panels being different. This difference in the depth of the support tracks on adjacent front panels allows the front panels to be positioned in an edge-overlapping manner on the back panel where the overlapping portions of an adjacent pair of front panels prevent light leaks between the panels. The alphanumeric or graphic display on the front panels may be disposed over the sets of interlocking tracks and may extend to the edges of the front panels to provide a continuous full view image on the front of the sign.

8 Claims, 3 Drawing Sheets

X
Y
10
12
12a
12b
12c
12d
14
14a
14b
14c
16
16a
16b
16c
16d
18
18a
18b
18c
18d
22
24
26a
26b
26c
26d

FULL VIEW CHANGEABLE DISPLAY SIGN

FIELD OF THE INVENTION

This invention relates generally to a display sign for presenting alphanumeric, or other symbol, messages or graphics, and is particularly directed to a full view changeable display sign which is backlit and has a plurality of indicia-bearing front panels removably attached to a translucent back panel by means of a parallel track arrangement, with the front panels arranged so as to provide a high contrast display.

BACKGROUND OF THE INVENTION

A common type of illuminated sign has a translucent face with a backlighting source and a horizontally aligned, vertically spaced track arrangement on the exterior face to permit various indicia such as alphanumeric characters to be presented in a designated arrangement in front of the translucent face so as to provide a message which is visible at night. The letters, numerals and other indicia are changeable in this type of sign. The display of graphics in this type of sign is not generally feasible because of the discontinuities arising from the horizontally aligned, vertically spaced tracks used to position the individual sign elements.

An example of this type of display sign is disclosed in U.S. Pat. No. 4,553,345, entitled "Display Letter Mounting and Method Therefor," which is assigned to the assignee of the present application. In this display sign, each letter, or alphanumeric character, is provided on an individual flat panel which is inserted in a sliding manner between generally horizontally oriented, parallel, upper and lower tracks. A light source is provided within the sign housing, with each panel including an opaque partition secured to a lateral edge of the panel along the length thereof so as to be positioned between immediately adjacent panels on the sign in an overlapping manner to prevent light leaks between adjacent panels. Other examples of parallel track display sign arrangements can be found in U.S. Pat. Nos. 4,461,107; 4,521,984; 4,817,316; 4,977,698; 5,088,221; 5,347,736; and 5,542,202.

Another common type of sign of a more permanent nature employs a large facia board typically covering the entire front of the sign. The facia board may be provided with intricate graphics or pictorial images, with the facia board generally comprised of a single translucent sheet-like member. Because the illuminated facia board consists of a single sheet-like member or several sheet-like members which are joined together in intimate contact along their adjacent edges, this type of illuminated sign is particularly adapted for displaying large intricate graphic images, including photographs. The message on this type of sign is not easily changeable as the facia board is frequently permanently installed on the sign front. An example of this type of illuminated sign can be found in U.S. Pat. No. 4,021,949.

The present invention addresses the aforementioned limitations of the prior art by providing a display sign and a parallel track support arrangement for a display sign which is used for engaging and supporting large translucent display panels which may contain either parallel arrays of alphanumeric characters, or other symbols, or large graphic images or even photographs. Light leaks between adjacent panels are eliminated by attaching the panels to the parallel tracks disposed on a translucent back panel in a manner which permits overlapping of the edges of adjacent panels to provide a high contrast display image.

OBJECTS AND SUMMARY OF THE INVENTION

Accordingly, it is an object of the present invention to provide an improved sign for displaying alphanumeric characters or other symbols, or graphic images on changeable panels arranged in a side-by-side, edge-overlapping manner wherein light leaks between adjacent panels are eliminated.

It is another object of the present invention to provide a full view graphics display sign having a plurality of side-by-side front panels, each having a plurality of horizontally aligned, vertically spaced mounting tracks on an aft surface thereof, where graphics may be provided on the entire forward surface of each of the front panels, including those portions disposed over the aforementioned mounting tracks.

Yet another object of the present invention is to securely mount in a removable manner an indicia-bearing front panel on a translucent back panel in an illuminated sign by means of a plurality of parallel, inter-fitting tracks disposed in a spaced manner on an aft surface of the front panel and a front surface of the back panel.

A further object of the present invention is to provide a backlit sign having indicia bearing front panels removably attached to a conventional sign face via horizontally aligned, vertically spaced mounting rails, where the entire surface of each front panel may include indicia such as alphanumeric characters or graphics including those portions of the front panels disposed over the mounting rails.

This invention contemplates a display sign having a source of backlighting comprising: a first generally planar translucent back panel positioned in front of the source of backlighting and having front and aft portions; a first plurality of elongated, linear tracks disposed in a spaced manner on the front portion of the back panel; second and third generally planar front panels each having respective front and aft portions and further including indicia thereon; and second and third pluralities of elongated, linear tracks disposed in a spaced manner on the aft portions of the second and third front panels, respectively, for engaging the first plurality of tracks and removably attaching the second and third front panels to the first back panel, wherein the second and third pluralities of tracks have respective thicknesses extending outwardly from the aft portions of the second and third front panels of $t_2$ and $t_3$, where $t_2>t_3$ to permit the second front panel to overlap the third front panel along adjacent edges thereof in preventing light from passing between the second and third front panels and providing a continuous display image.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
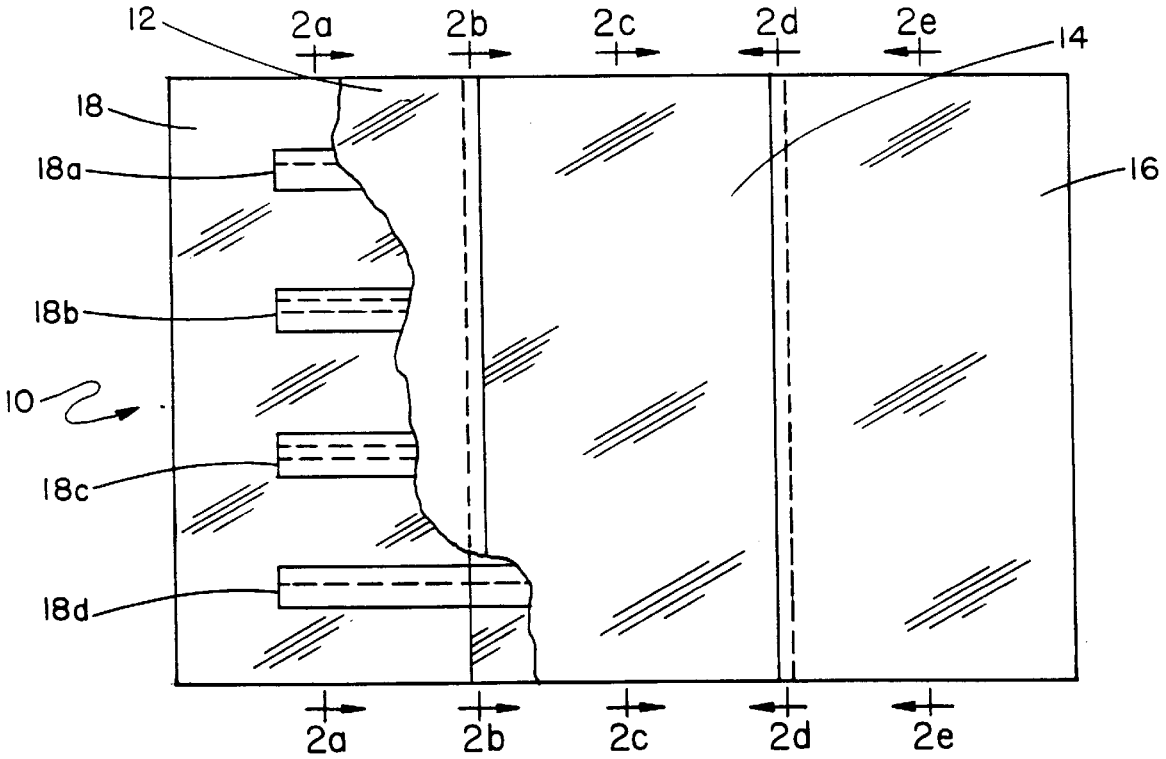
FIG. 1 is a front elevation view showing partially cut away and partially in phantom of a full view changeable display sign in accordance with the principles of the present invention.
Figures 2A, 2B, 2C, 2D, 2E, 3:
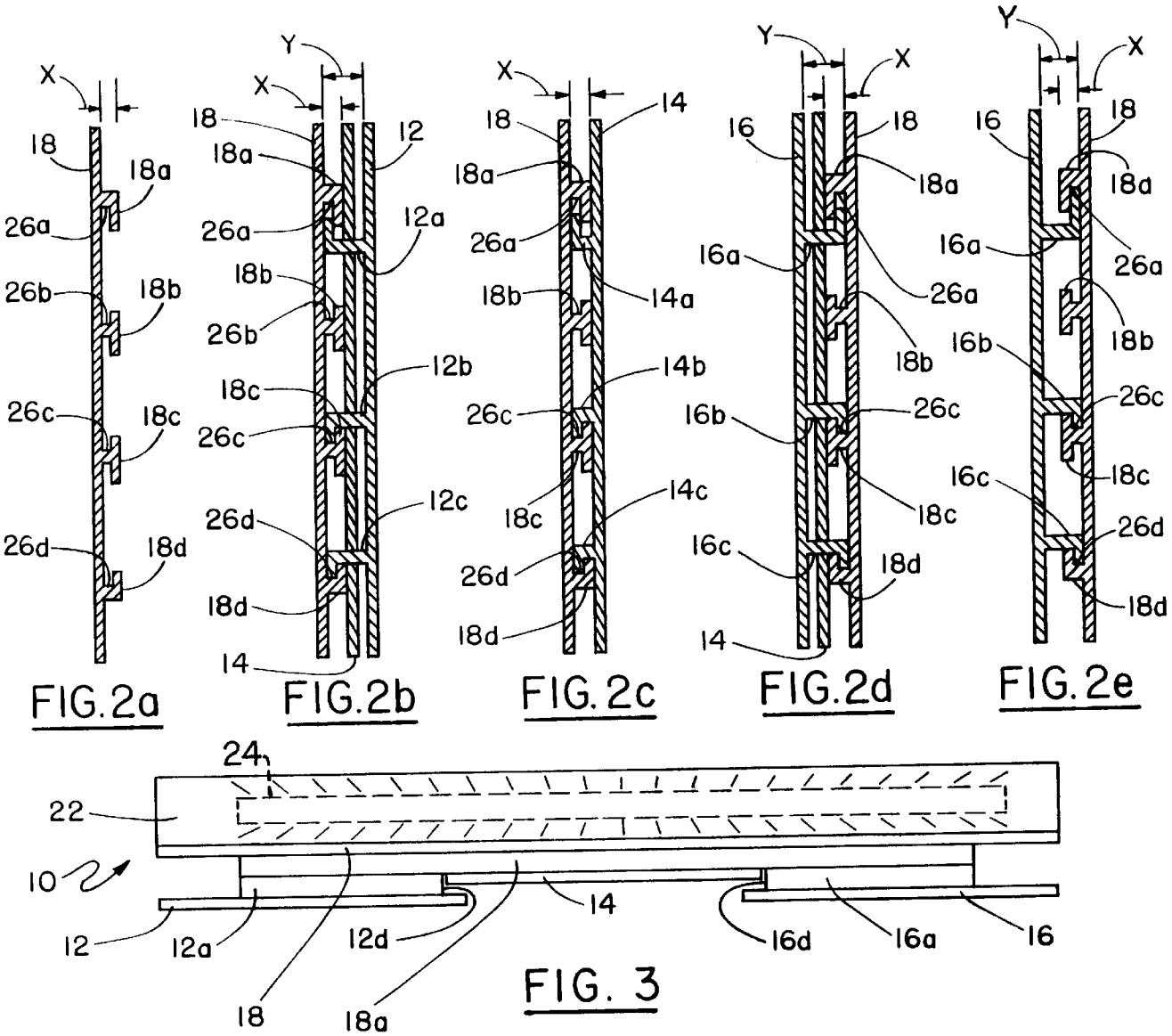
FIGS. 2*a*, 2*b*, 2*c*, 2*d* and 2*e* are sectional views of the full view changeable display sign of FIG. 1 respectively taken along site lines 2*a*—2*a*, 2*b*—2*b*, 2*c*—2*c*, 2*d*—2*d* and 2*e*—2*e* therein.
FIG. 3 is a top plan view of the full view changeable display sign shown in FIG. 1.

Referring to FIG. 1, there is shown partially cut away and partially in phantom a front elevation view of a full view changeable display sign 10 in accordance with the principles of the present invention. FIGS. 2*a*, 2*b*, 2*c*, 2*d* and 2*e* are sectional views of the display sign 10 shown in FIG. 1, taken respectively along site lines 2*a*, 2*b*, 2*c*, 2*d* and 2*e* therein. FIG. 3 is a top plan view of the display sign 10 shown in FIG. 1.

Display sign 10 includes first, second and third generally planar, rectangular front panels 12, 14 and 16 attached to a front portion of a planar, generally rectangular back panel 18. Back panel 18 is attached to a forward, open portion of a sign housing 22 which includes a light source 24 therein as shown in FIG. 3. The sign housing 22 is generally rectangular having back, top, bottom and side portions forming a generally closed structure open at the front. Back panel 18 is disposed on and attached to the open front portion of the sign housing 22 by conventional means which are not shown for simplicity and is translucent to allow for transmission of light from the light source 24 within the sign housing onto the three front panels 12, 14 and 18. Back panel 18 includes first, second, third and fourth elongated, generally linear tracks, or rails, 18*a*, 18*b*, 18*c* and 18*d* in proceeding downwardly on the back panel. Tracks 18*a*–18*d* are aligned generally horizontally and are arranged in a vertically spaced manner on a front portion, or surface, of the back panel 18. The first and fourth tracks, or top and bottom tracks, 18*a* and 18*d* are generally L-shaped in cross section. The second and third tracks 18*b*, 18*c* disposed intermediate the first and fourth tracks 18*a*, 18*d* are generally T-shaped in cross section. Each of the tracks 18*a*–18*d* is preferably formed integrally with the back panel 18 such as by molding, but also may be formed separately from the back panel and attached thereto by conventional means such as a high strength adhesive, e.g., an epoxy cement. Each of the tracks 18*a*–18*d* includes a distal portion forming a slot with an adjacent front portion of the back panel 18. Thus, distal upper portions of tracks 18*b*, 18*c* and 18*d* form slots 26*b*, 26*c* and 26*d* with adjacent front portions of the back panel 18. Similarly, a lower distal portion of the first track 18*a* forms a slot 26*a* with an adjacent forward portion of the back panel 18. Back panel 18 as shown in the figures with its equally spaced parallel tracks 18*a*, 18*b*, 18*c* and 18*d* is adapted to receive and support a plurality of flat panels (not shown) disposed between adjacent tracks, with each panel having a respective alphanumeric character or other symbol thereon. This type of parallel track, horizontally aligned alphanumeric character display sign is disclosed in aforementioned U.S. Pat. No. 4,553,345, as well as in the other patents listed above.

Each of the first, second and third front panels 12, 14 and 16 includes a respective plurality of tracks on an aft portion thereof. More specifically, the first front panel 12 includes first, second and third tracks 12*a*, 12*b* and 12*c*, while the second front panel 14 includes first, second and third tracks 14*a*, 14*b* and 14*c*. Finally, the third front panel 16 includes first, second and third tracks 16*a*, 16*b* and 16*c*. Each of the tracks attached to the respective aft portions of the first, second and third front panels 12, 14 and 16 is generally L-shaped, with the distal portion of each of the first upper tracks extending upwardly, and the distal end of each of the second and third tracks extending downwardly. The distal ends of each of the upper tracks 12*a*, 14*a* and 16*a* of the first, second and third front panels 12, 14 and 16 are adapted for insertion in the slot 26*a* formed by the first track 18*a* on the front portion of the back panel 18. Similarly, the middle, or intermediate, second tracks 12*b*, 14*b* and 16*b* of the first, second and third front panels 12, 14 and 16 is adapted for insertion in an upper slot formed by track 18*c* on the forward portion of the back panel 18. Finally, the distal end portions of the lower tracks 12*c*, 14*c* and 16*c* of the first, second and third front panels 12, 14 and 16 are each adapted for insertion in the slot 26*d* formed by the lower third track 18d*n* the front portion of the back panel 18.

All of the tracks on a given panel have the same depth, or extend outwardly from the panel the same distance. Thus, all of tracks 18*a*, 18*b*, 18*c* and 18*d* extend outwardly from the back panel 18 the same distance X as shown in FIGS. 2*a*–2*e*. Similarly, the three tracks on the first front panel 12 and on the third front panel 16 extend outwardly from the panel a distance Y as shown in FIGS. 2*b*, 2*d* and 2*e*. The depth of the three tracks 14*a*, 14*b* and 14*c* on the second front panel 14 is essentially equal to the distance the three tracks 18*a*, 18*b* and 18*c* extend outwardly from the back panel 18, which is the distance X as shown in FIG. 2*c*. Because of the differences in depth of the sets of tracks in each of the three front panels, the front panels may be arranged in an edge-overlapping manner as shown in FIGS. 1 and 3. Thus, because the tracks on the aft surfaces of the first and third front panels 12, 16 extend outwardly from these panels a distance Y which is greater than the distance X which the tracks on the second front panel 14 extend, the lateral edges of the first and third panels are disposed in front of the lateral edges of the second front panel. This overlapping of the edges of adjacent panels prevents light leaks between the panels to provide a high contrast display.

Figures 4A, 4B, 4C, 4D:
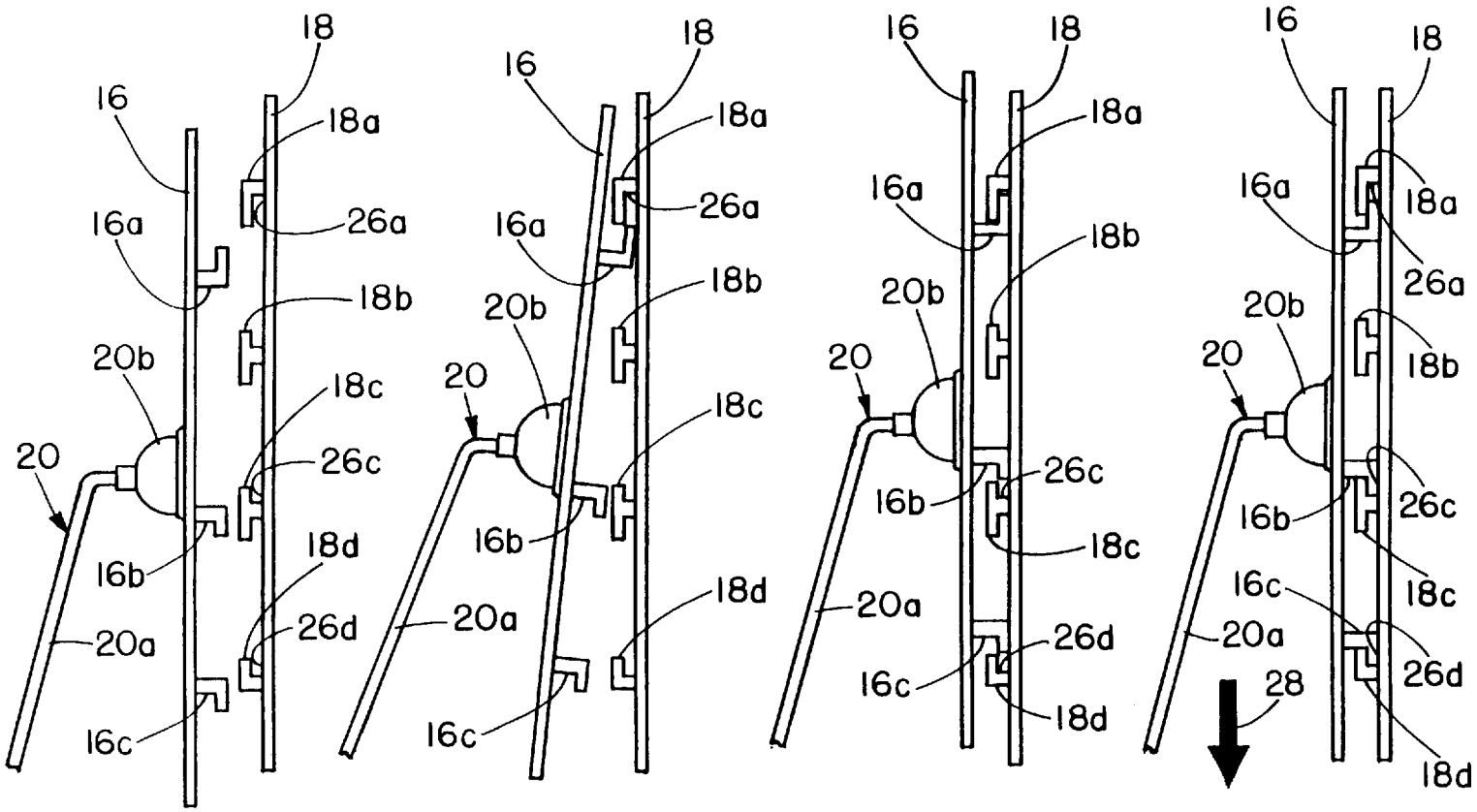
FIGS. 4*a*–4*d* illustrate the sequence of steps in attaching a front panel to a back panel using the interconnecting parallel track arrangement of the full view changeable display sign of the present invention.

Referring to FIGS. 4*a*–4*d*, there is shown a side elevation view of the third front panel 16 and back panel 18 illustrating the manner in which each of the front panels is securely and removably attached to the back panel. The front panels are engaged and either placed in position on or removed from the back panel 18 by means of a panel positioner 20. Panel positioner 20 is conventional in design and operation and includes an elongated handle 20*a* and a suction cup, or plunger portion, 20*b* for either installing the third front panel 16 on or removing the panel from the back panel 18 when the back panel is in an elevated position. As shown in FIG. 4*b*, the third front panel 16 is moved into position in close proximity to the four tracks on the front surface of the back panel 18. The top track 16*a* on the aft portion of the third front panel 16 is first inserted in slot 26*a* formed by the distal portion of the upper track 18*a* on the front surface of the back panel 18 with the two panels aligned generally parallel as shown in FIG. 4*c*. The third front panel 16 is then slid downwardly along the back panel 18 in the direction of arrow 28 in FIG. 4*d* such that the two lower tracks on each of the panels are in mutual engagement. Thus, when the third front panel 16 is lowered into position, tracks 16*b* and 16*c* on the rear surface of the third front panel 16 are positioned within respective slots 26*c* and 26*d* formed on the front surface of the back panel 18 by tracks 18*c* and 18*d*. With the third front panel 16 lowered into position on the back panel 18 as shown in FIG. 4*d*, upper track 16*a* on the back surface of the third front panel remains within slot 26*a* formed by the upper track 18*a* on the front surface of the back panel. In this manner, the third front panel 16 is securely positioned on the front surface of the back panel 18. The third front panel 16 is removed from the back panel 18 by reversing the sequence of steps shown in FIGS. 4*a*–4*d*.

After the three front panels 12, 14 and 16 are positioned on the back panel 18 as just described, the panels may be slid along the tracks on the back panel to a position where the panels are in an edge overlapping arrangement as shown in FIGS. 1 and 3. The extent of overlap of adjacent panels is limited by engagement of adjacent edges of the panels and their respective support tracks. Thus, as shown in FIG. 3, the first front panel 12 and the second front panel 14 are in proper alignment when the edges of the tracks on the first front panel engage an adjacent edge of the second front panel as shown for the edge 12*d* of the upper track 12*a* engaging and adjacent edge of the second front panel. Similarly, an edge 16*d* of the upper track 16*a* on the third front panel 16 engages an adjacent edge of second front panel 14 when these two panels are in proper edge-overlapping alignment as shown in FIG. 3. Proper alignment of adjacent front panels ensures the presentation of an uninterrupted, continuous message display on the front of the sign.

Figure 5:
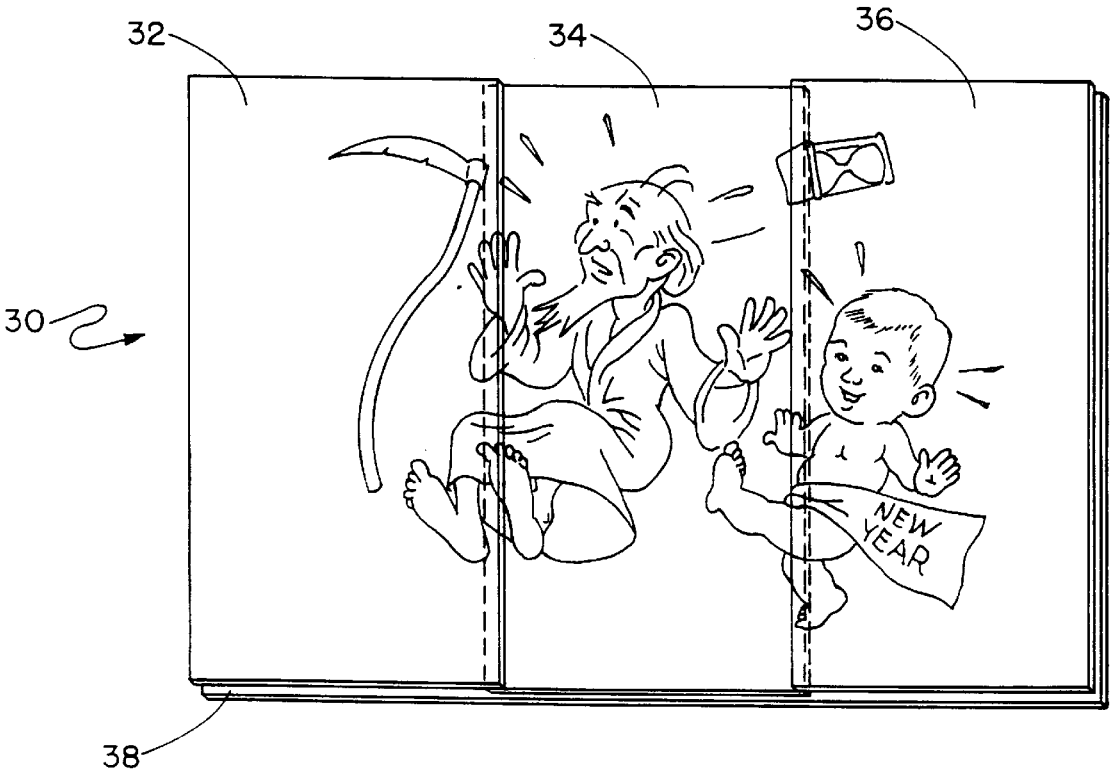
FIG. 5 is a front perspective view shown partially in phantom of the full view changeable display sign of the present invention showing the manner in which a graphic image may be presented on the multi-panel display sign.

Referring to FIG. 5, there is shown a front perspective view partially in phantom of a full view changeable display sign 30 in accordance with the present invention illustrating a graphic representation on the sign. Display sign 30 includes a back panel 38 to which are removably attached first, second and third front panels 32, 34 and 36 as in the previously described embodiment. Overlapping edge portions of the second front panel 34 with the first and third front panels 32, 36 are shown in dotted line form in the figure. From FIG. 5, it can be seen that the graphic display on the front of the display sign 30 may cover the entire front surfaces of the three front panels 32, 34 and 36 and may extend over the mounting tracks disposed on the rear surfaces of the three front panels as well as on the front surface of the back panel 38.

There has thus been shown a full view changeable display sign which includes a translucent, planar back panel attached to a front, open portion of a housing containing a light source. Attached to the front surface of the back panel are a plurality of edge-overlapping front panels which include display indicia. The front surface of the back panel and the rear surfaces of the front panels each include a respective plurality of horizontally aligned, vertically spaced inter-engaging mounting tracks for attaching the front panels to the back panel in a removable manner. The depth of the sets of tracks, or the extent each of the tracks on the front panels extends outward from the rear surface of the panel, is the same for all tracks on a given front panel, with the depth of the tracks on adjacent panels being different. This difference in the depth of the support tracks on adjacent front panels allows the front panels to be positioned in an edge-overlapping manner on the back panel, where the overlapping portions of an adjacent pair of front panels prevent light leaks between the panels to provide a high contrast display. The front panels may be provided with horizontal rows of alphanumeric characters, or other symbols, or may include respective portions of a large continuous graphic display, where the image may extend over the entire front panels including those portions of the front panels disposed over the mounting tracks on the aft surfaces thereof.

While particular embodiments of the present invention have been shown and described, it will be obvious to those skilled in the art that changes and modifications may be made without departing from the invention in its broader aspects. For example, while the present invention has been described in terms of three edge-overlapping front panels each having display indicia thereon, the present invention contemplates the use of virtually any number of front panels forming a display sign of any desired size. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A display sign comprising:

a first generally planar translucent back panel having opposed front and rear portions;

a first plurality of elongated, linear tracks disposed in a spaced manner directly on the front portion of said back panel;

second and third generally planar front panels each having respective opposed front and rear portions and further including indicia thereon; and second and third pluralities of elongated, linear tracks disposed in a spaced manner on the rear portions of said second and third front panels, respectively, engaging said first plurality of tracks and removably attaching said second and third front panels to said first back panel, wherein said second and third pluralities of tracks have respective thicknesses extending outwardly from the rear portions of said second and third front panels of $t_2$ and $t_3$, where $t_2>t_3$, said second front panel overlaps said third front panel along adjacent edges thereof for preventing light from passing between said second and third front panels and providing a continuous display image.

2. The display sign of claim 1 wherein spacing between the tracks in said first, second and third plurality of tracks is generally uniform.

3. The display sign of claim 1 further comprising stop means for aligning said second and third front panels by limiting the extent of overlap of said second and third front panels.

4. The display sign of claim 3 wherein said stop means includes adjacent edges of said tracks and panels disposed in abutting contact.

5. The display sign of claim 1 wherein each of said tracks includes a distal edge forming a slot with its associated panel, and wherein each of said slots is adapted to receive and engage a respective distal edge of a track to which it is coupled.

6. The display sign of claim 5 wherein an upper and a lower track of said first plurality of tracks are generally L-shaped in cross section, and wherein each of said upper and lower tracks includes a respective inwardly directed slot for receiving and engaging a respective distal edge of a track to which it is coupled.

7. The display sign of claim 6 wherein said first plurality of tracks further includes intermediate tracks disposed between said upper and lower tracks, and wherein each of said intermediate tracks is generally T-shaped in cross section.

8. The display sign of claim 7 wherein each of said tracks in said second and third pluralities of tracks is generally L-shaped in cross section.

* * * * *

UNITED STATES PATENT AND TRADEMARK OFFICE

CERTIFICATE OF CORRECTION

PATENT NO. : 5,832,643

DATED : November 10, 1998

INVENTOR(S) : Gary E. Delaquila, James W. Leone and Harold J. Smith

It is certified that error appears in the above-indentified patent and that said Letters Patent is hereby corrected as shown below:

Column 4, line 16, "18dn" should be -- 18d on --.

Signed and Sealed this

Sixteenth Day of March, 1999

*Attest:*

*Attesting Officer*

Q. TODD DICKINSON

*Acting Commissioner of Patents and Trademarks*